US005285740A

United States Patent [19]

Yanagi et al.

[11] Patent Number: 5,285,740

[45] Date of Patent: Feb. 15, 1994

[54] HORIZONTAL SPOOL PIN SUPPORTING DEVICE FOR A SEWING MACHINE

[75] Inventors: Kinzaburo Yanagi, Mouka; Isao Takizawa, Tochigi, both of Japan

[73] Assignee: The Singer Company NV, Curaoco, Netherlands Antilles

[21] Appl. No.: 984,823

[22] Filed: Dec. 3, 1992

[30] Foreign Application Priority Data

Feb. 28, 1992 [JP] Japan ..... 4-18214[U]

[51] Int. Cl.[5] ..... D05B 75/00

[52] U.S. Cl. ..... 112/258; 242/137

[58] Field of Search ..... 112/258, 302, 279, 169, 112/259; 242/55.19 A, 77.1, 137, 137.1, 138, 130.3, 130.4, 146

[56] References Cited

U.S. PATENT DOCUMENTS

| | | | |
|---|---|---|---|
| 1,467,473 | 9/1923 | Bussiere | 112/169 |
| 1,976,037 | 10/1934 | Rawlings | 242/137 |
| 2,900,941 | 8/1959 | Platt | 112/258 X |
| 3,473,756 | 10/1969 | Jones | 242/137 |
| 3,645,220 | 2/1972 | Casas-Robert | 112/279 X |
| 3,749,039 | 7/1973 | Fritts | 112/302 |
| 4,498,405 | 2/1985 | Hanyu et al. | 112/302 X |
| 4,936,234 | 6/1990 | Jimenez et al. | 112/302 X |
| 5,063,866 | 11/1991 | Jimenez et al. | 112/302 |

*Primary Examiner*—Clifford D. Crowder
*Assistant Examiner*—Paul C. Lewis

[57] ABSTRACT

A horizontal spool pin supporting device for a sewing machine comprising a spool pin having a spool mounting portion and a swingingly guided portion. An upper cover for covering the upper portion of the sewing machine body has a recess which has an opening on one of the vertical side walls and is capable of receiving the spool mounting portion of the spool pin together with the spool while it is mounted thereon. A spool pin guiding portion is defined b the opposing side surfaces of vertically extending two projections disposed on the back side of the side wall and is integrally formed with the upper cover. The swingingly guided portion of the spool pin, when it is inserted into the opening, is swingable and is guided by the spool pin guiding portion while the upper edge portion of the opening serves as a fulcrum for the turning of the spool pin.

3 Claims, 5 Drawing Sheets

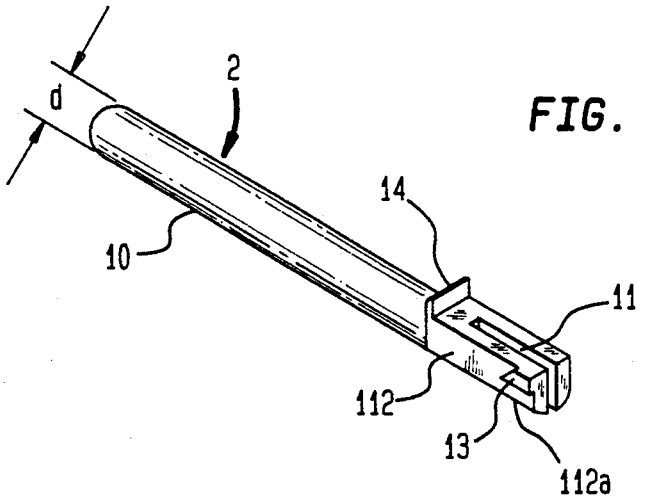
FIG. 10
FIG. 11
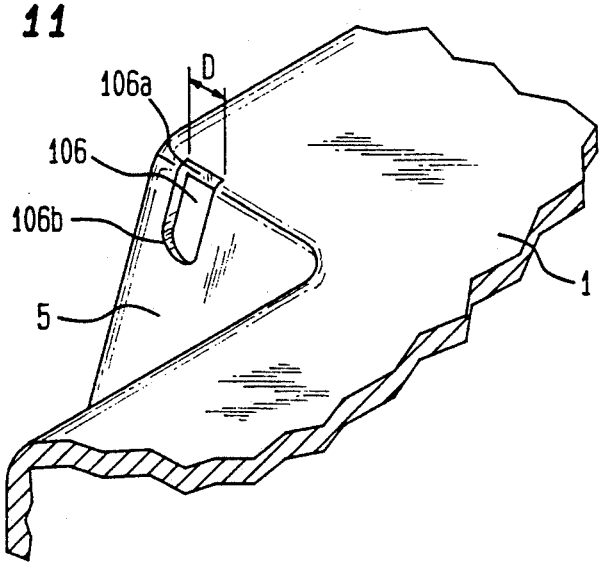
FIG. 12
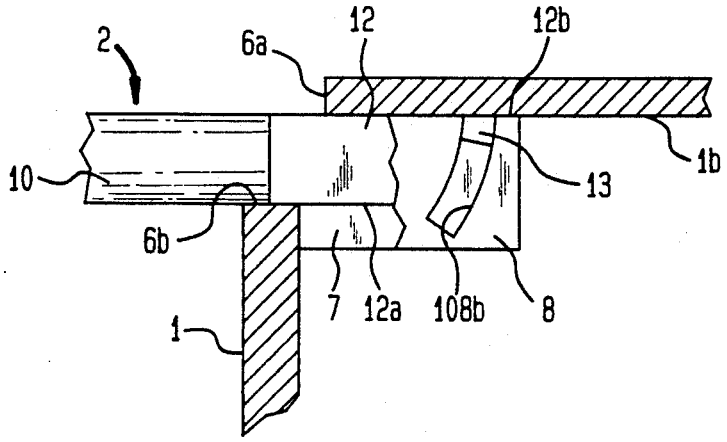

HORIZONTAL SPOOL PIN SUPPORTING DEVICE FOR A SEWING MACHINE

BACKGROUND OF THE INVENTION

1. Field of the Invention

The present invention relates to a horizontal spool pin supporting device for a sewing machine and, more particularly relates to a sewing machine in which a spool pin mounted on the upper cover of the machine is in parallel with the clamp face of the upper cover.

2. Description of the Prior Art

A conventional horizontal spool pin supporting device is incorporated in desk sewing machines for home use is disclosed in Japanese Utility Model Provisional Publication No. 56-69366. A recess for accommodating a spool therein is formed in an upper cover of the sewing machine. The cover is constructed to be very small and yet accommodate the spool pin. The spool pin is raised up at a predetermined angle in the cover only when a spool is detached from or attached to the pin. The spool pin is fixedly held by the upper cover to be substantially horizontal when the spool pin on which a spool is mounted is turned down at a predetermined angle.

The conventional horizontal spool pin supporting device comprises a spool pin having a base plate which is swingably supported on the inside of the upper cover. A click mechanism of a spring member releases the base plate when the spool pin is raised up. Additional members such as the base for supporting the spool pin, a supporting member having a fulcrum for swingably supporting the base plate are required. The resulting structure is complicated and the assembly of these components is troublesome. It is the object of the present device to provide a horizontal spool pin supporting device for a sewing machine which uses a simple structure for swingably supporting the spool pin and does not us a base plate separated from the spool pin or supporting members separated from the upper cover.

SUMMARY OF THE DEVICE

A horizontal spool pin supporting device for a sewing machine in accordance with the invention comprise a spool pin having a spool mounting portion for mounting the spool thereon and a swingingly guided portion which is coupled to the spool mounting portion. Both portions extend in the axial direction. An upper cover for covering the upper portion of the sewing machine body has a recess which is formed therein. The recess has an opening on one of the vertical side walls thereof and is capable of receiving the spool mounting portion of the spool pin together with the spool while it is mounted on the spool mounting portion. A spool pin guiding portion is defined by the opposing side surfaces of vertically extending two projections disposed on the both back sides of the opening and is integrally formed under the upper cover. The swingingly guided portion of the spool pin guiding portion while the upper edge portion of the opening serves as a fulcrum for the turning of the spool pin.

A stopper portion is formed at the central portion of the spool pin and a convex portion is formed on the swingingly guided portion. The convex portion is slidably engaged on a circular arc guiding portions having a center of the arc at the upper edge portion of the opening, while the stopper portion is retained by the upper edge portion of the opening so that the spool pin is prevented from moving in the axial direction.

When a spool is mounted to or exchanged in such a horizontal spool pin supporting device, the spool mounting portion of the spool pin is pulled up so that the spool pin is raised up to some extend. That is, when the spool mounting portion is pulled up, the spool pin is turned about the upper edge portion of the opening while the swingingly guided portion thereof is guided by the spool pin guiding portion. When the spool pin is raised up, a spool can be mounted on the spool mounting device.

The spool pin with the spool mounted thereon is pushed down at the side of the spool mounting portion to be received in the recess. The recess can receive the spool pin almost horizontally therein, i.e., in parallel with the clamp face of the upper cover, since the recess is large enough to receive therein the spool pin together with the spool. In this way, a sewing operation is carried out by the sewing machine with the spool and the spool pin received in the recess.

A convex portion formed on the swingingly guided portion slidably engages the circular arc guiding portion which is formed on either of the edge surfaces of the projections and has its center of the arc at the upper edge portion of the opening. A stopper portion formed on the spool pin is retained by the upper edge portion of the opening so that the spool pin is prevented from moving in the axial direction by the stopper portion and the convex portion. When the spool pin is raised up, the spool pin is turned about a fulcrum where the stopper portion is retained by the upper edge portion of the opening as the convex portion slides along the circular arc guiding portion. At that point the swingingly guided portion slides in the spool pin guiding portion.

Consequently the invention enhances the ease of manufacturing and assembly and permits the use of synthetic resin without moulding in metal moulds. The spool pin guiding portion is formed at the rear side of the upper cover integrally therewith and does not employ additional members besides the upper cover and the spool pin. The structure is simplified and both outside and inside of the upper cover easily shaped.

BRIEF DESCRIPTION OF THE DRAWINGS

FIG. 10 is a perspective view showing the upper side of a spool pin according to a second embodiment.

FIG. 11 is a perspective view showing a part of the outside of the upper cover according to this second embodiment.

FIG. 12 is an enlarged cross-sectional view showing a part of a spool pin supporting device according to a third embodiment.

DESCRIPTION OF THE PREFERRED EMBODIMENTS

Figure 3:
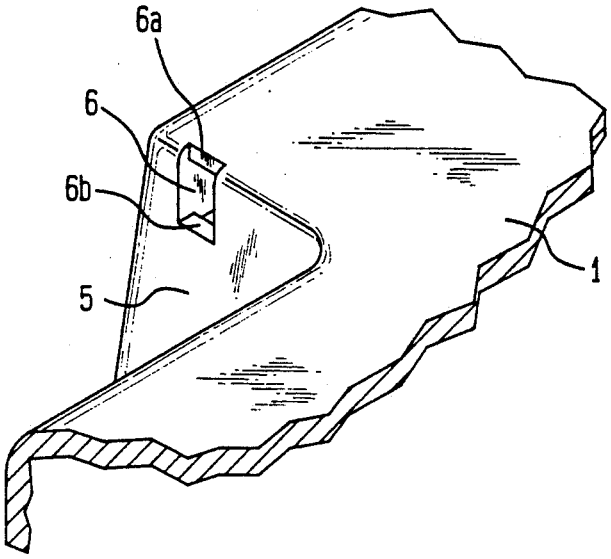
FIG. 3 is a perspective view showing a part of the outside of the upper cover in FIG. 1.
Figure 7:
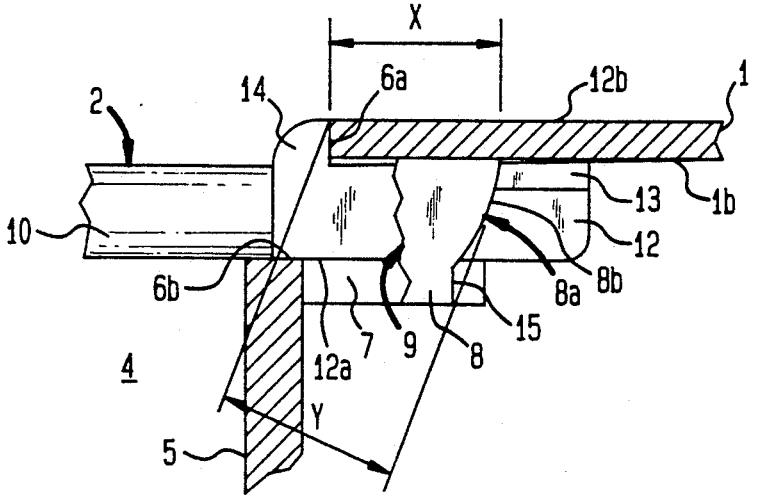
FIGS. 7 and 8 are views illustrating the operation of the spool pin supporting device in FIG. 1.
Figure 8:
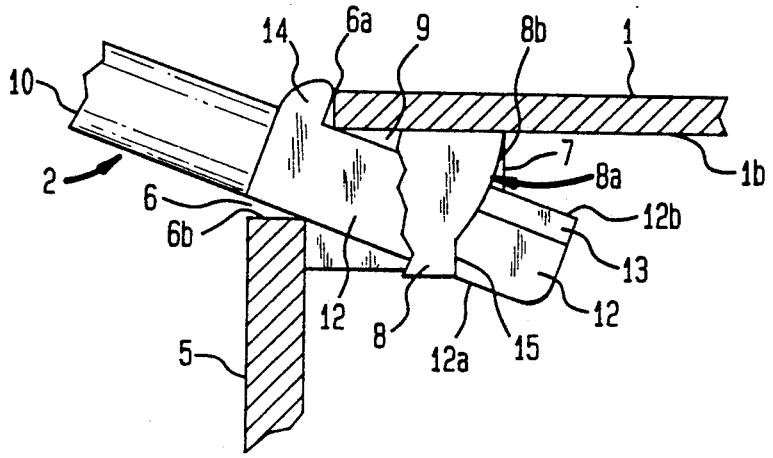
Figure 9:
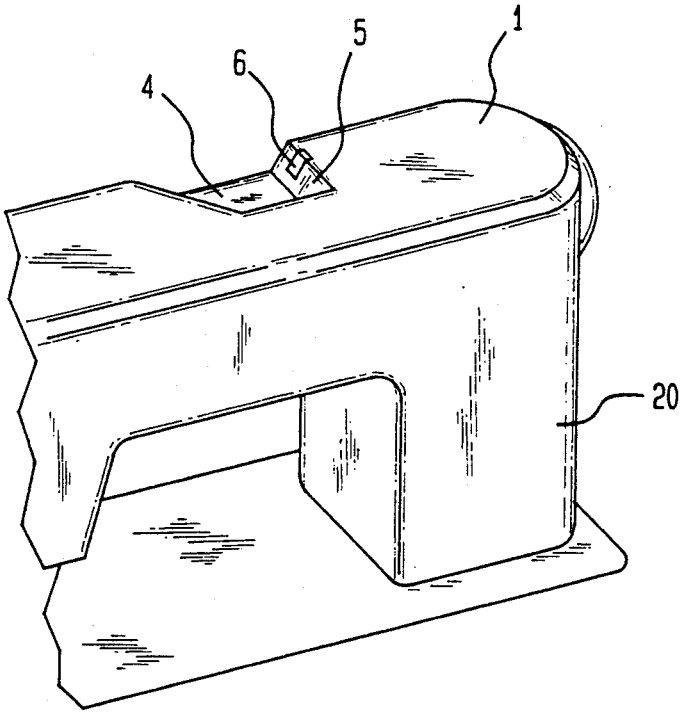
FIG. 9 is a perspective view showing a sewing machine in FIG. 1 omitting a part thereof.

FIGS. 1 to 9 show a first embodiment of the invention. An upper cover 1 covers the upper portion of a sewing machine body 20 as illustrated in FIG. 9. A recess 4, which is large enough to receive therein a spool pin 2 together with a spool 3 mounted thereon, is formed at the central portion of the outer rear side of the upper cover 1. A rectangular opening 6 which is large enough to have the spool pin 2 inserted thereinto is located in the upper portion of a vertical side wall 5 which forms the rear side of the recess 4 as illustrated in FIG. 3.

Figure 4:
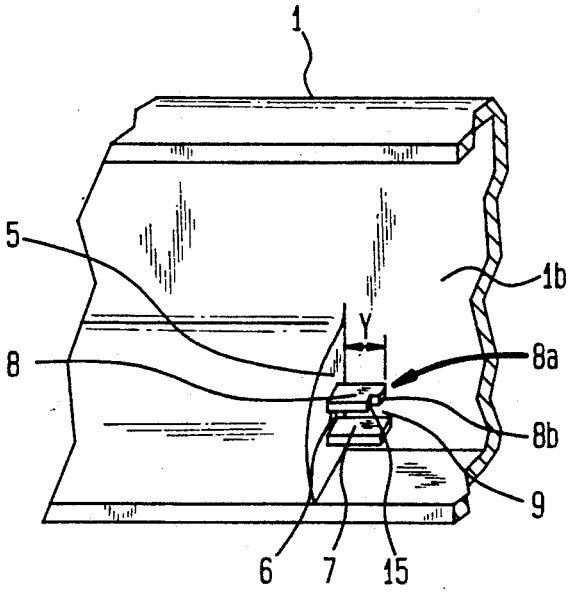
FIG. 4 is a perspective view showing a part of the inside of the upper cover in FIG. 1.

Formed on the inside of the upper cover 1 are projections 7 and 8 which are disposed on the back side of the side wall 5 and at both sides of the opening 6 at an interval to apply an appropriate friction to the swingingly guided portion 12 of the spool pin 2 inserted into a slit defined therebetween as illustrated in FIG. 4. The slit defined between the opposing side surfaces of the vertically extending projections 7 and 8 constitutes a spool pin guiding portion 9. The projections 7 and 8 are formed of a synthetic resin integrally with the upper cover 1.

Figure 5:
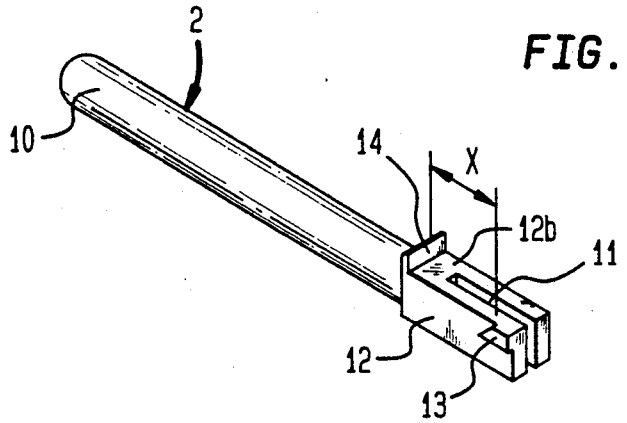
FIG. 5 is a perspective view showing the upper side of the spool pin in FIG. 1.
Figure 6:
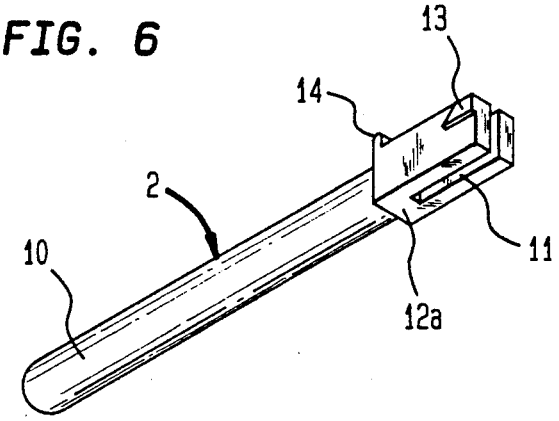
FIG. 6 is a perspective view showing the lower side of the spool pin in FIG. 1.

The spool pin 2 composed of a synthetic resin comprises a spool mounting portion 10 on which a spool is mounted and a swingingly guided portion 12 coupled to the spool mounting portion 10. Both spool mounting portion 10 and the swingingly guided portion 12 extend in the axial direction of the spool pin 2 as illustrated in FIGS. 5 and 6. The spool mounting portion 10 of the spool pin 2 has a circular cross section while the swingingly guided portion 12 has a rectangular cross section. The swingingly guided portion 12 which engages the opening 6 at the left and right surfaces thereof has such width as to be inserted into the opening 6 with appropriate friction, and has a vertical slit 11 extending in the axial direction at the tip end thereof. The spool pin 2 is guided in turning as the swingingly guided portion 12 thereof slides in the spool pin guiding portion 9 formed between the projections 7 and 8. Small gaps are defined between the opening 6 and the upper and lower surfaces of the swingingly guided portion 12 so that the spool pin 2 may be freely turnable.

Furthermore, the swingingly guided portion 12 comprises a convex portion 13 protruding laterally at the tip end thereof and a stopper portion 14 protruding upward at the central portion of the spool pin 2 adjacent to the border between the spool mounting portion 10 and the swingingly guided portion 12.

The projection 8 comprises a circular arc portion 8*b* at the upper portion of the edge 8*a* thereof and a linear retaining portion 15 extending vertically at the lower portion of the edge 8*a* as illustrated in FIGS. 4 and 7. The circular arc portion 8*b* has a radius equal to the radius X of the concave fan-shaped portion defined between the stopper portion 14 of the spool pin 2 and the inner side of the convex portion 13 on the swingingly guided portion 12. The radius X of the concave fan-shaped portion conforms to the radius Y of the convex fan-shaped portion formed between the circular arc portion 8*b* at the upper portion of the edge 8*a* of the projection 8 provided inside the upper cover 1 and the upper edge portion 6*a* of the opening 6.

When the spool pin 2 is held almost horizontally and the swingingly guided portion 12 having a convex portion 13 is inserted into the opening 6, the gap of the slit 11 is reduced until the stopper portion 14 is stopped by the upper edge portion 6*a* of the opening 6. The slit 11 is then elastically restored to its original state and the convex portion 13 engages the circular arc portion 8*b* of the projection 8. As a result, the spool pin 2 is prevented from moving in the axial direction and is fixed to the upper cover 1. At this state, the lower surface 12*a* of the swingingly guided portion 12 is brought into contact with the lower edge portion 6*b* of the opening 6 and the upper surface 12*b* of the swingingly guided portion 12 is brought into contact with the back side of the upper cover 1, so that the spool pin 2 can be almost horizontally supported by the side wall 5 of the accommodating recess 4 of the upper cover 1. In this way, the spool pin 2 can be fixed to the side wall 5 while being only vertically turnable.

The operation of the spool pin supporting device according to the embodiment set forth above is described with reference to FIGS. 7 and 8 hereinafter.

When a spool 3 is attached to or exchanged in the sewing machine, the spool mounting portion 10 of the spool pin 2 is pulled up so as to be raised up to some extent. That is, when the spool mounting portion 10 is pulled up, the spool pin 2 is turned about the fulcrum where the stopper portion 14 engages with the upper edge portion 6*a* of the opening 6 as the convex portion 13 slides along the circular arc portion 8*b* and the swingingly guided portion 12 slides in the spool pin guiding portion 9 defined between the projections 7 and 8. At this point, there is friction between the swingingly guided portion 12 and the spool pin guiding portion 9 and between the left and right contacting surfaces of the swingingly guided portion 12 and the opening 6. The upward turning of the spool pin 2 is stooped when the convex portion 13 is retained by the retaining portion 15 adjacent to the circular arc portion 8*b*. When the spool pin 2 is raised up, a spool 3 is mounted on the spool pin 2. The spool pin 2 is held in position by friction.

Figure 1:
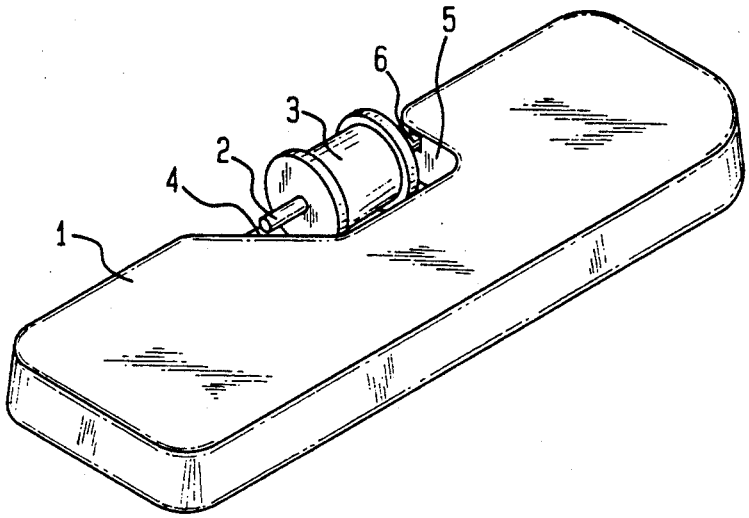
FIG. 1 is perspective view showing the outside of the upper cover to which a horizontal spool pin supporting device for a sewing machine according to a first embodiment of the invention is mounted.
Figure 2:
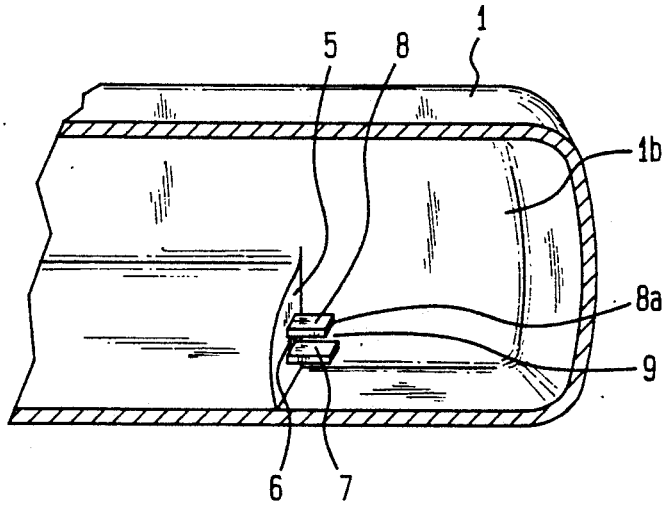
FIG. 2 is a view showing a part of the inside of the upper cover in FIG. 1.

Thereafter the spool pin 2 on which the spool 3 is mounted is pushed down at the side of the spool mounting portion 10 thereof so as to be received in the recess 4. The friction also assists when the spool pin 2 is turned down. The recess 4 can receive the spool pin 2 almost horizontally, i.e., parallel with the clamp face of the upper cover 1 as illustrated in FIG. 1 since the recess is large enough to be able to receive the spool pin 2 together with the spool 3 mounted thereon.

In this way, the sewing operation can be carried out by the sewing machine with the spool 3 and the spool pin 2 received in the recess 4.

FIGS. 10 and 11 show an opening 6 and the swingingly guided portion 12 of a spool pin 2 according to a second embodiment of the present invention, wherein the opening 106 has a so-called D hole having a diameter of D at the lower edge portion 106*b* thereof and the swingingly guided portion 112 has a convex curved surface having a diameter of D at the lower surface 112*a* thereof, wherein the D hole conforms to the convex curved surface of the swingingly guided portion 112. The spool pin 2 can be also turned between the horizontal state and the raised up state with this arrangement with the same function as the first embodiment. The fulcrum about which the spool pin 2 is turned is at the upper edge portion 106*a* of the opening 106.

FIG. 12 shows a third embodiment, in which a circular arc groove 108*b* is formed in the projection 8 instead of the circular arc portion 8*b* in the first and second embodiments, and the convex portion 13 is engaged in the circular arc groove 108*b*. According to the third embodiment, the stopper portion 14 can be omitted since the convex portion 13 is engaged in the circular arc groove 18*b* so that the spool pin 2 is prevented from moving in the axial direction thereof. The retaining portion 15 adjacent to the circular arc portion 8*b* can be also omitted since the convex portion 13 is retained at the end of the circular arc groove 108*b* so that the turning of the spool pin 2 is stopped. The fulcrum of the turning of the spool pin 2 is at the upper edge portion 6*a* of the opening 6.

What is claimed is:

1. A horizontal spool pin supporting device in combination with a sewing machine having a body, said combination comprising:

a spool having an axial direction;

a spool pin having a spool mounting portion for mounting the spool thereon, a stopper portion formed at a central portion thereof and a swingingly guided portion which is coupled to the spool mounting portion and has a convex section, said portions being arranged in said axial direction;

an upper cover for covering an upper portion of said body, the upper cover having an accommodating recess which is formed therein for accommodating therein the spool mounting portion together with the spool when it is mounted thereon, said recess having vertical side walls, one of the side walls having an opening, said opening having a back side and an upper edge;

first and second parallel vertically extending projections disposed on the back side of the opening and having edge surfaces and opposing side surfaces;

a circular arc guiding portion which is slidably engaged by the convex portion of the spool pin, the arc guiding portion having a center at the upper edge of the opening and being formed on one of the edge surfaces of the projections;

a spool pin guiding portion being integral with the upper cover and being defined by the opposing side surfaces of the projections, said swingably guided portion being swingably inserted into said opening between said opposing side surfaces, said upper edge constituting a fulcrum for turning of the spool pin, the stopper portion being retained by the upper edge of the opening to prevent the spool pin from moving in the axial direction.

2. A horizontal spool pin supporting device in combination with a sewing machine having a body, said combination comprising:

a spool having an axial direction;

a spool pin having a spool mounting portion for mounting the spool thereon and a swingingly guided portion which is coupled to the spool mounting portion, the swingably guided portion having a lower surface which has a convex curvature, both portions being arranged in said axial direction;

an upper cover for covering an upper portion of said body, the upper cover having an accommodating recess which is formed therein for accommodating therein the spool mounting portion together with the spool when it is mounted thereon, said recess having vertical side walls, one of the side walls having an opening, said opening having a back side, a lower edge and an upper edge, the lower edge having a D-shaped hole therein, the D-shaped hole conforming to said convex curvature;

first and second parallel vertically extending projections disposed on the back side of the opening and having opposing side surfaces;

a spool pin guiding portion being integral with the upper cover and being defined by the opposing side surfaces of the projections, said swingably guided portion being swingably inserted into said opening between the opposing side surfaces, said upper edge constituting a fulcrum for turning of the spool pin.

3. A horizontal spool pin supporting device in combination with a sewing machine having a body, said combination comprising:

a spool having an axial direction;

a spool having a spool mounting portion for mounting the spool thereon and a swingingly guided portion which is coupled to the spool mounting portion, the swingably guided portion having a convex section, both portions being arranged in said axial direction;

an upper cover for covering an upper portion of said body, the upper cover having an accommodating recess which is formed therein for accommodating therein the spool mounting, said recess having vertical side walls, one of the side walls having an opening, said opening having a back side and an upper edge;

first and second parallel vertically extending projections disposed on the back side of the opening and having opposing side surfaces, one of the projections having a circular arc groove in which said convex section is engaged;

a spool pin guiding portion being integral with the upper cover and being defined by the opposing side surfaces of the projection, said swingably guided portion being swingably inserted into said opening between the opposing side surfaces, said upper edge constituting a fulcrum for the turning of the spool pin.

* * * * *